US008886083B2

(12) United States Patent
Igarashi et al.

(10) Patent No.: US 8,886,083 B2
(45) Date of Patent: Nov. 11, 2014

(54) IMAGE FORMING APPARATUS PROVIDED WITH DEVELOPING UNIT DETACHABLY MOUNTABLE THEREIN

(71) Applicants: Hiroshi Igarashi, Nagoya (JP); Shougo Sato, Seto (JP)

(72) Inventors: Hiroshi Igarashi, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 60 days.

(21) Appl. No.: 13/796,476

(22) Filed: Mar. 12, 2013

(65) Prior Publication Data

US 2013/0322918 A1 Dec. 5, 2013

(30) Foreign Application Priority Data

May 31, 2012 (JP) ..... 2012-124413

(51) Int. Cl.

| | |
|---|---|
| ***G03G 15/00*** | (2006.01) |
| ***G03G 21/18*** | (2006.01) |
| ***G03G 15/04*** | (2006.01) |
| ***G03G 21/16*** | (2006.01) |

(52) U.S. Cl.
CPC ..... *G03G 21/1604* (2013.01)
USPC ..... 399/110; 399/113; 399/119

(58) Field of Classification Search
CPC ..... G03G 21/1604
USPC ..... 399/110, 113, 119, 120
See application file for complete search history.

(56) References Cited

U.S. PATENT DOCUMENTS

| | | | | |
|---|---|---|---|---|
| 7,526,228 | B2 * | 4/2009 | Shiraki | 399/113 X |
| 7,715,756 | B2 * | 5/2010 | Hattori | 399/119 |
| 7,720,413 | B2 * | 5/2010 | Kamimura et al. | 399/113 X |
| 8,005,404 | B2 | 8/2011 | Sato | |
| 2007/0280730 | A1 * | 12/2007 | Okabe et al. | 399/113 X |
| 2009/0274491 | A1 | 11/2009 | Sato | |
| 2009/0324283 | A1 * | 12/2009 | Mushika et al. | 399/119 |
| 2010/0074646 | A1 * | 3/2010 | Miyahara et al. | 399/99 |
| 2011/0286772 | A1 | 11/2011 | Sato | |
| 2011/0299885 | A1 | 12/2011 | Taba | |
| 2012/0189356 | A1 | 7/2012 | Sato | |

FOREIGN PATENT DOCUMENTS

| | | |
|---|---|---|
| JP | 2009-265537 A | 11/2009 |
| JP | 2011-253048 A | 12/2011 |

* cited by examiner

*Primary Examiner* — Sandra Brase
(74) *Attorney, Agent, or Firm* — Banner & Witcoff, Ltd.

(57) ABSTRACT

An image forming apparatus includes: a photosensitive drum; a developing unit; and a casing. The developing unit includes a developing agent bearing member having an axis defining a first side and a second side in an axial direction. The casing supports the photosensitive drum and the developing unit. The casing has an opening at a position corresponding to the first side. The developing unit is detachable from and attachable to the casing through the opening. The developing unit is movable selectively to one of a proximity position, a separated position, and a pivoted position where the developing agent bearing member is pivotally moved about a portion of the developing agent bearing member at the second side from the separated position in a direction away from the photosensitive drum. The developing unit is detachable from and attachable to the casing along the axial direction in a state where the developing unit is at the pivoted position.

19 Claims, 11 Drawing Sheets

IMAGE FORMING APPARATUS PROVIDED WITH DEVELOPING UNIT DETACHABLY MOUNTABLE THEREIN

CROSS REFERENCE TO RELATED APPLICATION

This application claims priority from Japanese Patent Application No. 2012-124413 filed May 31, 2012. The entire content of the priority application is incorporated herein by reference.

TECHNICAL FIELD

The present invention relates to an image forming apparatus including a developing unit detachably mountable in a casing thereof.

BACKGROUND

There is conventionally known an image forming apparatus provided with a main casing, an intermediate transfer belt, a plurality of process units disposed below the intermediate transfer belt, and a drawer supporting the plurality of process units and drawable from the main casing. In this configuration, the process units each integrally include a photosensitive drum and a developing unit having a developing roller for supplying toner to the photosensitive drum and a toner chamber, and can each be replaced with new one by drawing the drawer from the main casing.

SUMMARY

In general, the photosensitive drum is replaced with new one at a frequency lower than a frequency of toner replacement (i.e., replacement of the developing unit). Therefore, also in the above-mentioned configuration, the developing unit is desired to be replaced without removing the photosensitive drum from the main casing.

In order to achieve this, a configuration may be possible in which the developing roller (developing unit) is slightly separated from the photosensitive drum, and then the developing unit is drawn in an axial direction of the developing roller. In this case, however, there is a possibility that the developing unit slightly moves in a direction perpendicular to the axial direction of the developing roller while the developing unit is drawn in the axial direction, which causes the developing roller and the photosensitive drum to slidingly contact with each other, thereby damaging the photosensitive drum.

In view of the foregoing, it is an object of the present invention to provide an image forming apparatus capable of suppressing interference between the developing agent bearing member and the photosensitive drum when the developing unit is moved in the axial direction.

In order to attain the above and other objects, the present invention provides an image forming apparatus including: a photosensitive drum; a developing unit; and a casing. The developing unit includes a developing agent bearing member configured to supply a developing agent to the photosensitive drum. The developing agent bearing member has an axis extending in an axial direction and defining a first side and a second side opposite to the first side in the axial direction. The casing is configured to support the photosensitive drum and the developing unit. The casing has an opening at a position corresponding to the first side. The developing unit is detachable from and attachable to the casing through the opening. The developing unit is configured to move selectively to one of a proximity position where the developing agent bearing member is in contact with or in proximity to the photosensitive drum, a separated position where the developing agent bearing member is spaced apart from the photosensitive drum while a parallel positional relationship between the developing agent bearing member and the photosensitive drum is maintained, and a pivoted position where the developing agent bearing member is pivotally moved about a portion of the developing agent bearing member at the second side from the separated position in a direction away from the photosensitive drum. The developing unit is configured to be detached from and attached to the casing along the axial direction in a state where the developing unit is at the pivoted position.

According to another aspect, the present invention provides an image forming apparatus including: a photosensitive drum; a developing unit; and a casing. The developing unit includes a developing agent bearing member configured to supply a developing agent to the photosensitive drum. The developing agent bearing member has an axis extending in an axial direction and defining a first side and a second side opposite to the first side in the axial direction. The casing is configured to support the photosensitive drum and the developing unit. The casing has an opening at a position corresponding to the first side. The developing unit is detachable from and attachable to the casing through the opening. The developing unit is configured to move selectively to one of a proximity position where the developing agent bearing member is in contact with or in proximity to the photosensitive drum, and a pivoted position where the developing agent bearing member is pivotally moved about a portion of the developing agent bearing member at the second side from the proximity position in a direction away from the photosensitive drum. The developing unit is configured to be detached from and attached to the casing along the axial direction in a state where the developing unit is at the pivoted position.

BRIEF DESCRIPTION OF THE DRAWINGS

In the drawings;

FIGS. 10A and 10B are views for illustrating a structure of a moving assembly, in which FIG. 10A shows the moving assembly in the state where the developing unit is at the proximity position; and FIG. 10B shows the moving assembly in the state where the developing unit is at the separated position; and FIGS. 11A and 11B are schematic perspective views for illustrating how the developing unit is detached, in which FIG. 11A shows a state where the color printer is installed in a narrow shelf; and FIG. 11B shows a state where the developing unit is detached from a drawer casing that has been drawn from the main casing.

DETAILED DESCRIPTION

A color printer as an image forming apparatus according to one embodiment of the present invention will be described with reference to FIGS. 1 through 11B. Throughout the specification, the terms "upward", "downward", "upper", "lower", "above", "below", "beneath", "right", "left", "front", "rear" and the like will be used assuming that the color printer 1 is disposed in an orientation in which it is intended to be used. More specifically, in FIG. 1 a left side and a right side are a front side and a rear side, respectively. Further, in FIG. 1 a near side and a far side are a right side and a left side, respectively. Further, in FIG. 1, a top side and a bottom side are a top side and a bottom side, respectively.

Figure 1:
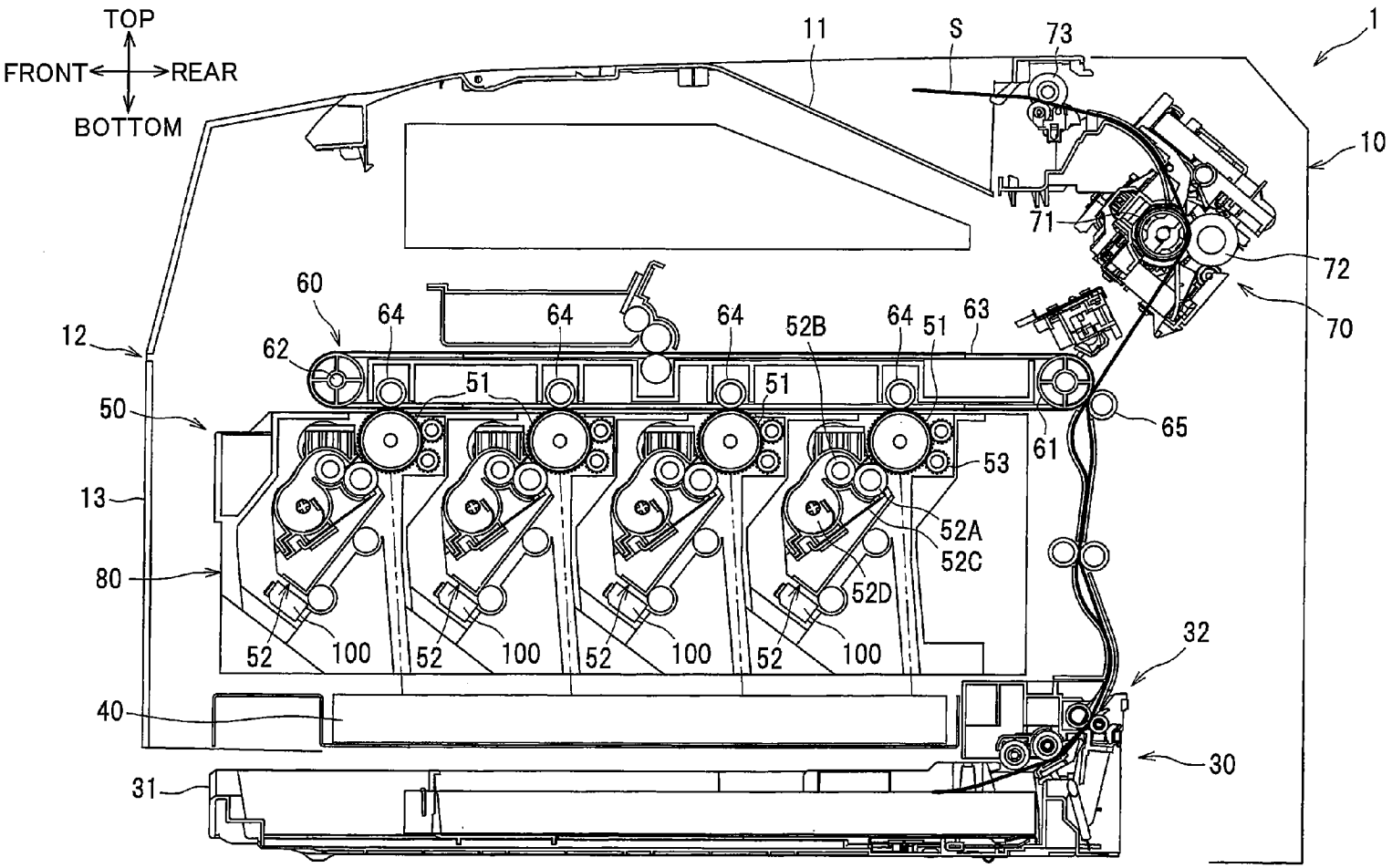
FIG. 1 is a cross-sectional view of a color printer according to one embodiment of the present invention.

Referring to FIG. 1, the color printer 1 includes a main casing 10, and within the main casing 10, further includes a sheet supply unit 30, a scanner unit 40, a photosensitive member unit 50, a transfer unit 60, and a fixing unit 70.

A discharge tray 11 onto which a sheet S discharged from the main casing 10 is placed is provided at an upper portion of the main casing 10. Further, a front cover 13 is supported to a front wall of the main casing 10. The front wall of the main casing 10 is formed with an opening 12 through which the photosensitive member unit 50 is drawn outside the main casing 10. The front cover 13 is pivotally movable between an open position for opening the opening 12 and a closed position for closing the opening 12.

The sheet supply unit 30 is provided at a lower portion of the main casing 10, and includes a sheet supply tray 31 and a sheet supplying mechanism 32. The sheet supply tray 31 is adapted to accommodate the sheets S therein. The sheet supplying mechanism 32 is adapted to convey the sheets S from the sheet supply tray 31 to a transfer position (a portion between an intermediate transfer belt 63 and a secondary transfer roller 65). The sheets S accommodated in the sheet supply tray 31 are separately conveyed one by one by the sheet supplying mechanism 32 to the transfer position.

The scanner unit 40 is disposed above the sheet supply tray 31, and includes a laser beam emitting portion, a polygon mirror, a lens, and a reflection mirror (which are not illustrated). A laser beam emitted from the scanner unit 40 passes through each path denoted by a chain double-dashed line to be irradiated onto a surface of each photosensitive drum 51 inside the photosensitive member unit 50 with high-speed scanning.

The photosensitive member unit 50 is disposed above the scanner unit 40. The photosensitive member unit 50 is supported to the main casing 10 and movable (drawable) in a frontward/rearward direction. More specifically, the photosensitive member unit 50 is movable through the opening 12 of the main casing 10 between an inside position (position illustrated in FIG. 1) at which the photosensitive member unit 50 is positioned inside the main casing 10 and an outside position (position illustrated in FIG. 2) at which the photosensitive member unit 50 is positioned outside the main casing 10.

Figure 2:
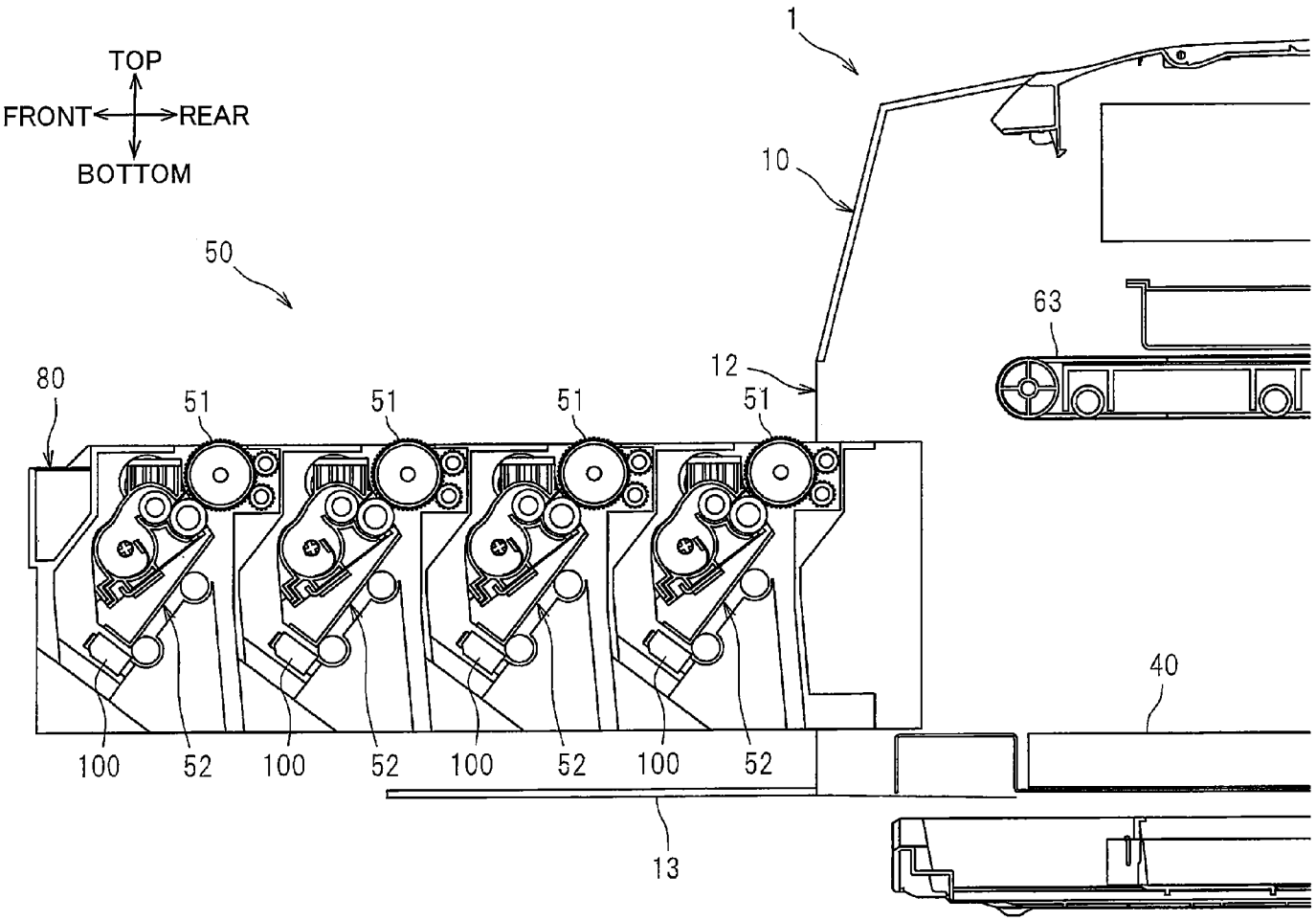
FIG. 2 is a partial cross-sectional view of the color printer according to the embodiment, showing a state in which a photosensitive member unit is drawn outward of a main casing.

It should be noted that, when the photosensitive member unit 50 is at the outside position as shown in FIG. 2, the photosensitive member unit 50 is still partly attached to the main casing 10. However, the photosensitive member unit 50 may be entirely detached from the main casing 10 when the photosensitive member unit 50 is at the outside position.

The photosensitive member unit 50 includes four photosensitive drums 51, four developing units 52, and a drawer casing 80. Details of the drawer casing 80 will be described later.

Figure 3:
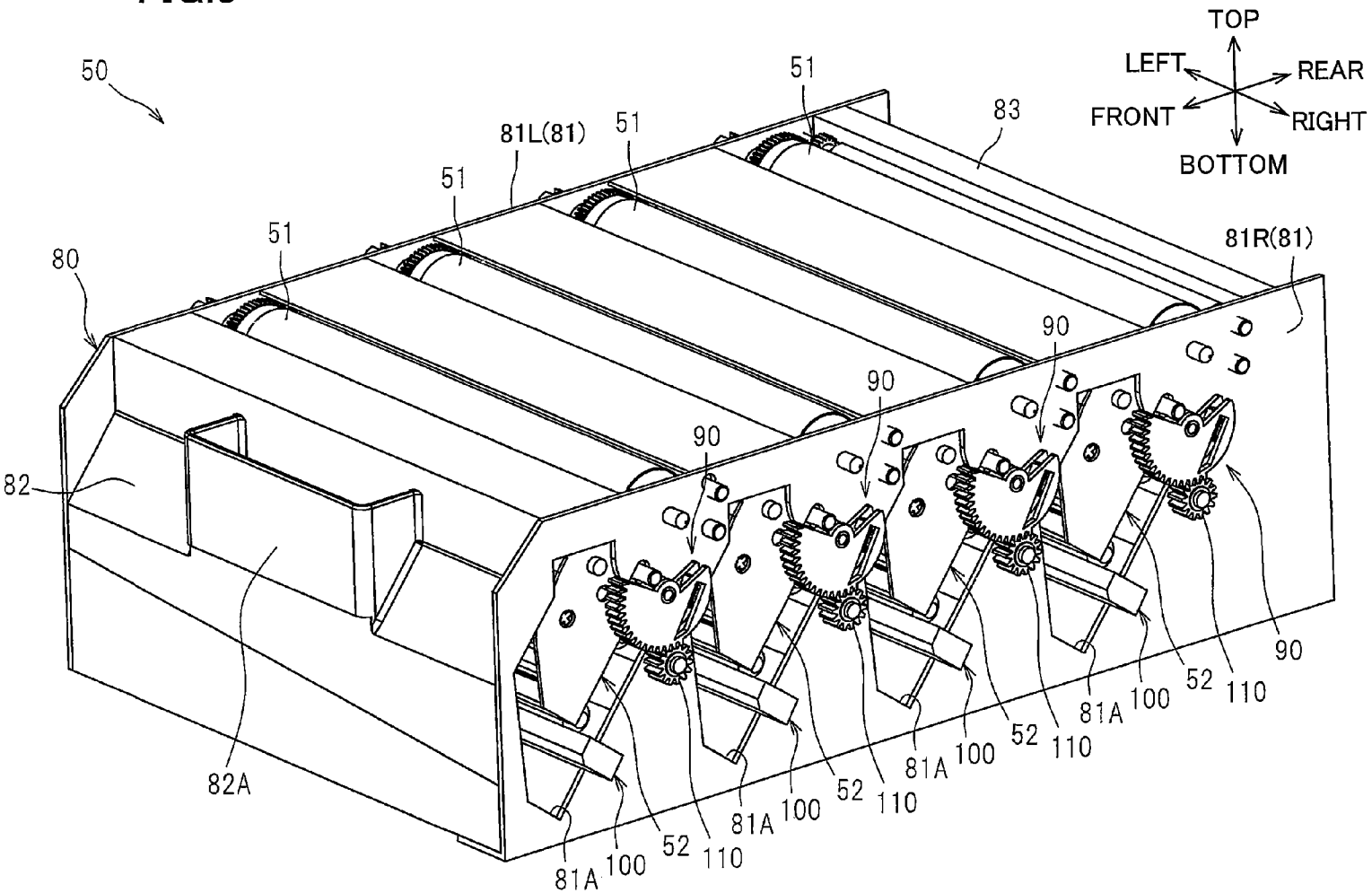
FIG. 3 is a perspective view of the photosensitive member unit in a state where a developing unit is at a proximity position.

The photosensitive drums 51 are arranged spaced apart from each other in the frontward/rearward direction and are each rotatably supported to left and right side walls 81 of the drawer casing 80, as illustrated in FIG. 3. Each photosensitive drum 51 has a surface to be charged by a charging roller 53, as illustrated in FIG. 1.

The developing units 52 are each detachably supported to the drawer casing 80, and each include a developing roller 52A (developing agent bearing member), a toner supply roller 52B, a layer thickness regulating blade 52C, and a toner chamber 52D. The developing roller 52A has an axis extending in the rightward/leftward direction (axial direction).

The transfer unit 60 is disposed above the photosensitive member unit 50, and includes a drive roller 61, a driven roller 62, the endless intermediate transfer belt 63, and four primary transfer rollers 64, and the secondary transfer roller 65. The intermediate transfer belt 63 is stretched around the drive roller 61 and the driven roller 62. The four primary transfer rollers are disposed opposite to the four photosensitive drums 51, respectively, with the intermediate transfer belt 63 interposed therebetween. The secondary transfer roller 65 is disposed opposite to the drive roller 61 with the intermediate transfer belt 63 interposed therebetween.

In the photosensitive member unit 50 and the transfer unit 60 described above, after the surface of the photosensitive drum 51 is uniformly charged by the charging roller 53, the surface is exposed to the laser beam emitted from the scanner unit 40, whereby an electrostatic latent image based on image data is formed on the surface. The toner accommodated in the toner chamber 52D is supplied, through the toner supply roller 52B, to the developing roller 52A to be carried on a surface thereof in a form of a thin toner layer having a uniform thickness by the layer thickness regulating blade 52C.

The toner carried on the surface of the developing roller 52A is supplied to the electrostatic latent image formed on the surface of the photosensitive drum 51. As a result, a visible toner image corresponding to the electrostatic latent image is formed on the surface of the photosensitive drum 51. Toner images of different colors formed on the respective photosensitive drums 51 are sequentially transferred onto the intermediate transfer belt 63 in an overlapping manner. Then, the sheet S conveyed from the sheet supply unit 30 passes through the transfer position between the intermediate transfer belt 63 and the secondary transfer roller 65, whereby the toner images on the intermediate transfer belt 63 are transferred onto the sheet S as one toner image.

The fixing unit 70 is disposed above and rearward of the transfer unit 60, and includes a heat roller 71 and a pressure roller 72. The pressure roller 72 is disposed in confrontation with the heat roller 71 and adapted to press the heat roller 71. In the fixing unit 70, while the sheet S onto which the toner image has been transferred passes between the heat roller 71 and the pressure roller 72, the toner image is thermally fixed onto the sheet S. The sheet S discharged from the fixing unit 70 is discharged outside the main casing 10 by a discharge roller 73 to be placed onto the discharge tray 11.

<Structure of Drawer Casing 80>

As illustrated in FIG. 3, the drawer casing 80 has left and right side walls 81, a front wall 82 connecting front ends of the side walls 81, and a rear wall 83 connecting rear ends of the side walls 81. Hereinafter, the side wall 81 on the left side will be referred to as the left side wall 81L, and the side wall 81 on the right side will be referred to as the right side wall 81R, when it is necessary to distinguish between the two.

The right side wall 81R is formed with four openings 81A through which the four developing units 52 are individually drawn diagonally below and rightward. The four openings 81A are arranged spaced apart from each other in the frontward/rearward direction. A holding portion 82A is provided at the front wall 82. The holding portion 82A is adapted to be held by a user when the user draws the drawer 80 from the main casing 10.

Further, the drawer casing 80 includes eight moving assemblies 90, four of which are provided outside the left side wall 81L and the remaining four are outside the right side wall 81R (see FIG. 4A), and four supporting members 100 which are provided in the drawer casing 80. Each moving assembly 90 is adapted to move the developing roller 52A in proximity to (in contact with) the photosensitive drum 51 and away from the photosensitive drum 51. Each supporting member 100 is adapted to pivotally move the developing unit 52, which has been moved away from the photosensitive drum 51 by the moving assemblies 90, in a direction away from the photosensitive drum 51. The supporting member 100 has a left end portion at which a pivot shaft 101 is provided.

Figure 4A:
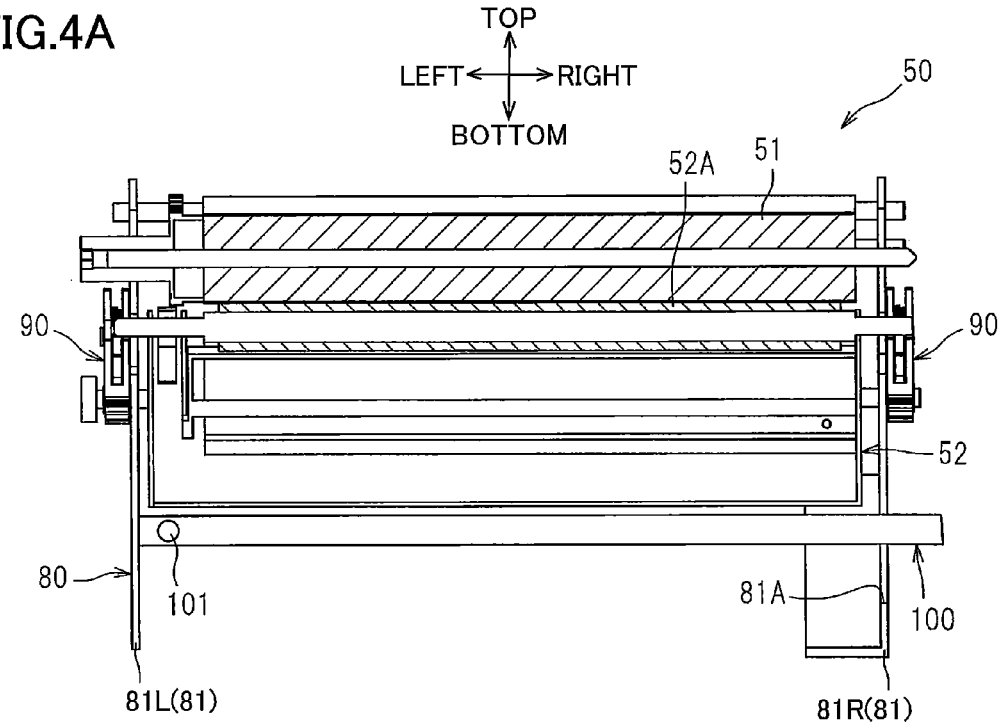
FIG. 4A is a cross-sectional view of the photosensitive member unit in the state where the developing unit is at the proximity position.
Figure 4B:
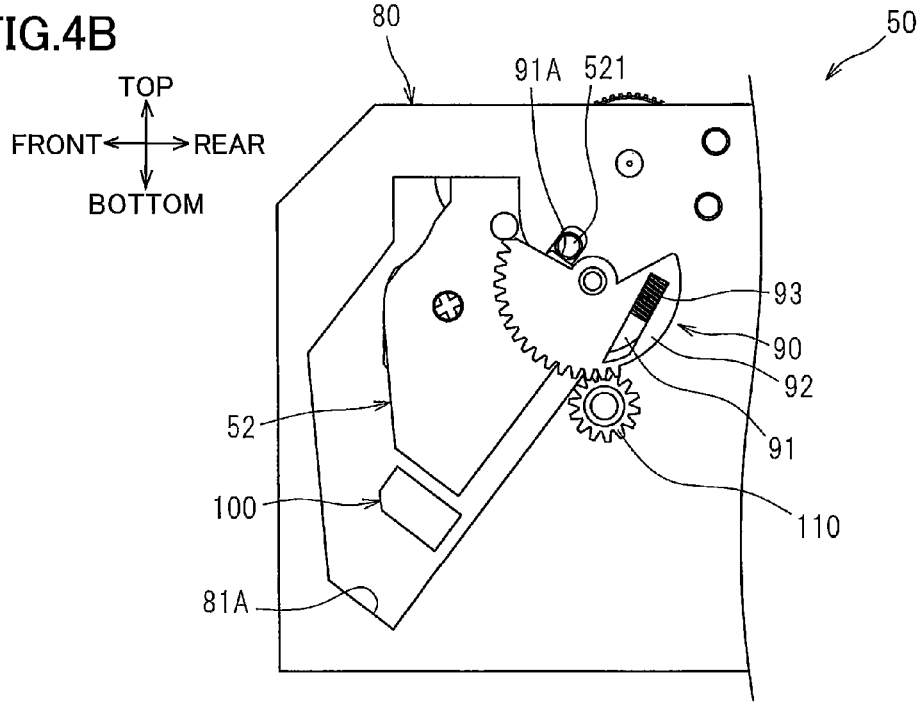
FIG. 4B is a partial side view of the photosensitive member unit in the state where the developing unit is at the proximity position.
Figure 5:
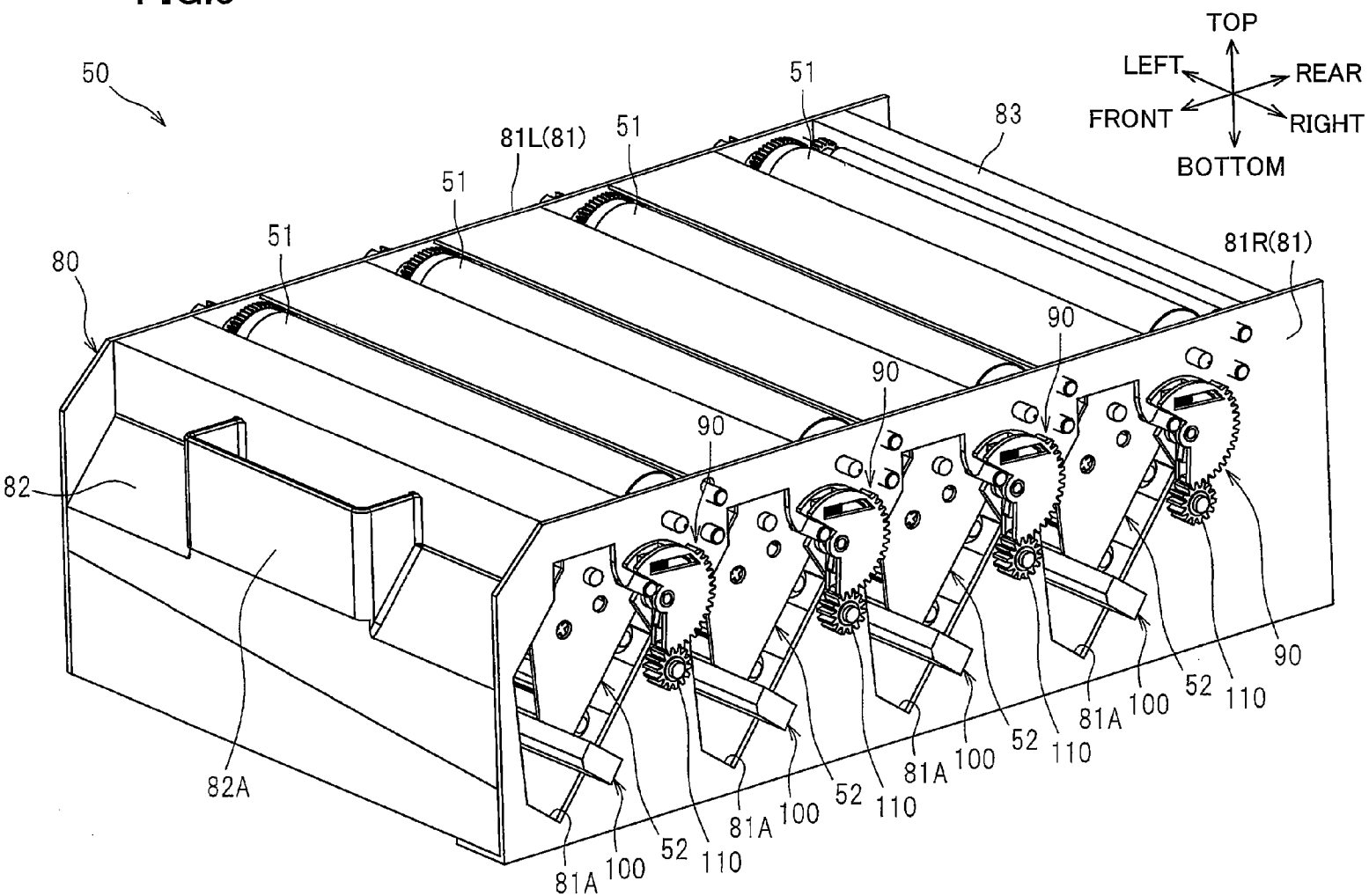
FIG. 5 is a perspective view of the photosensitive member unit in a state where the developing unit is at a separated position.
Figure 6A:
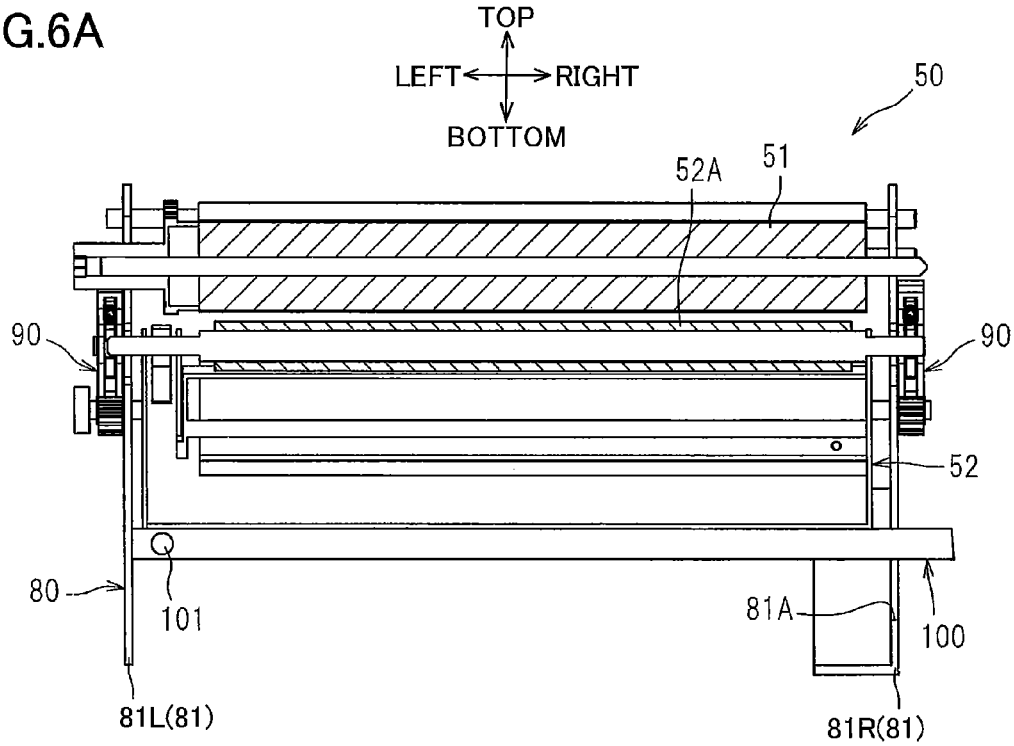
FIG. 6A is a cross-sectional view of the photosensitive member unit in the state where the developing unit is at the separated position.
Figure 6B:
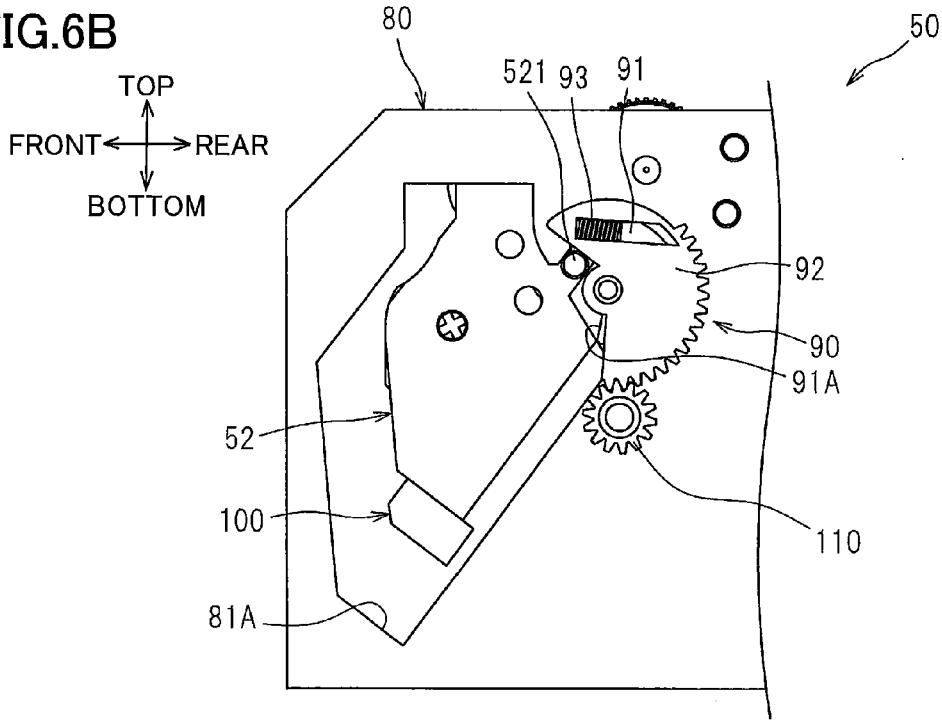
FIG. 6B is a partial side view of the photosensitive member unit in the state where the developing unit is at the separated position.
Figure 7:
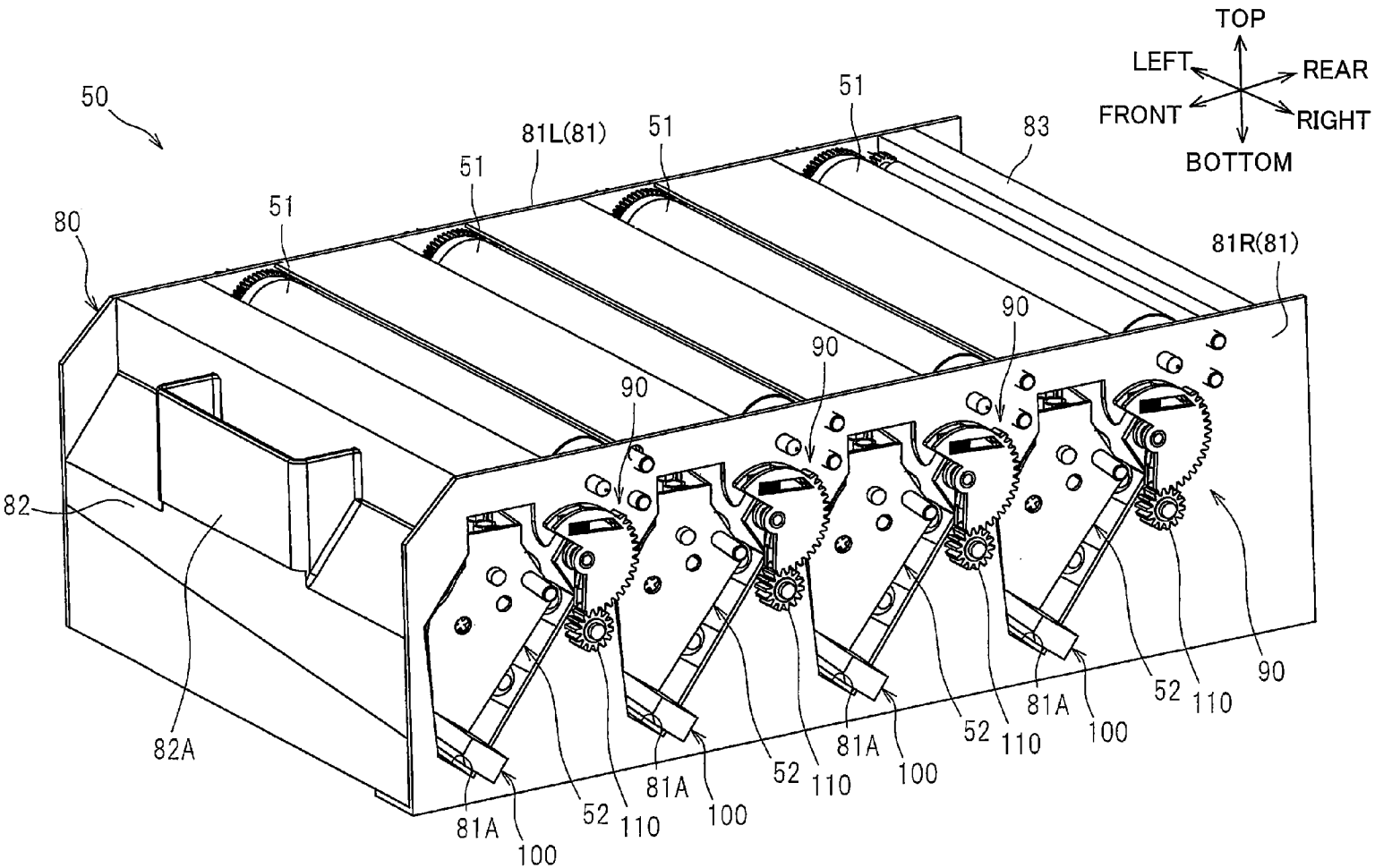
FIG. 7 is a perspective view of the photosensitive member unit in a state where the developing unit is at a pivoted position.
Figure 8A:
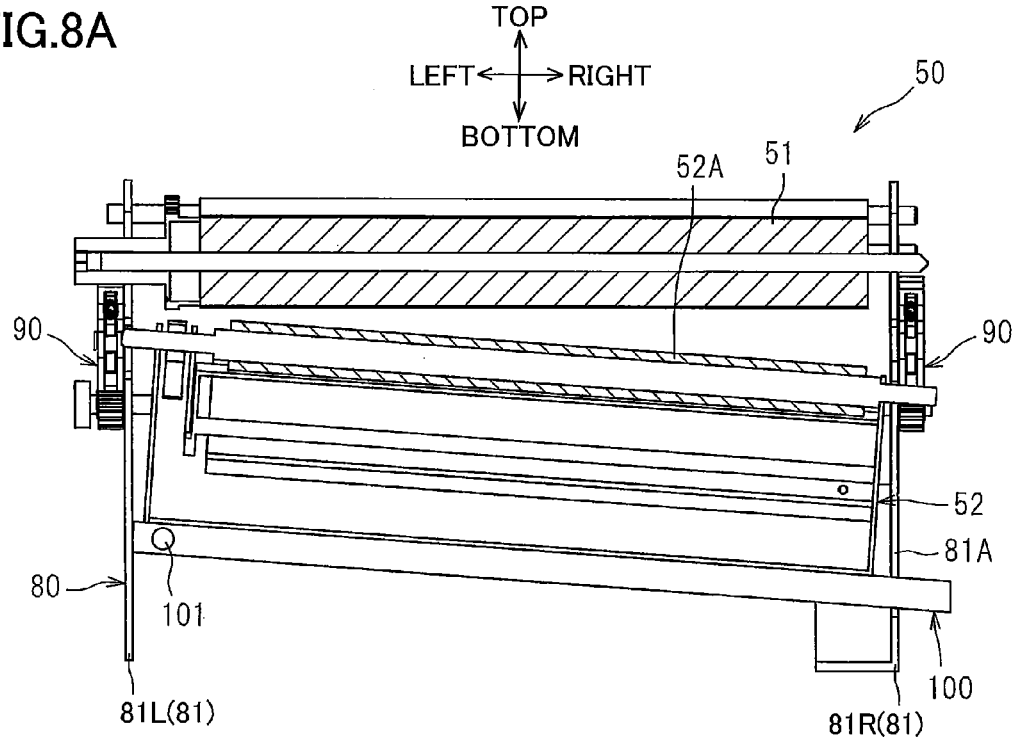
FIG. 8A is a cross-sectional view of the photosensitive member unit in the state where the developing unit is at the pivoted position.
Figure 8B:
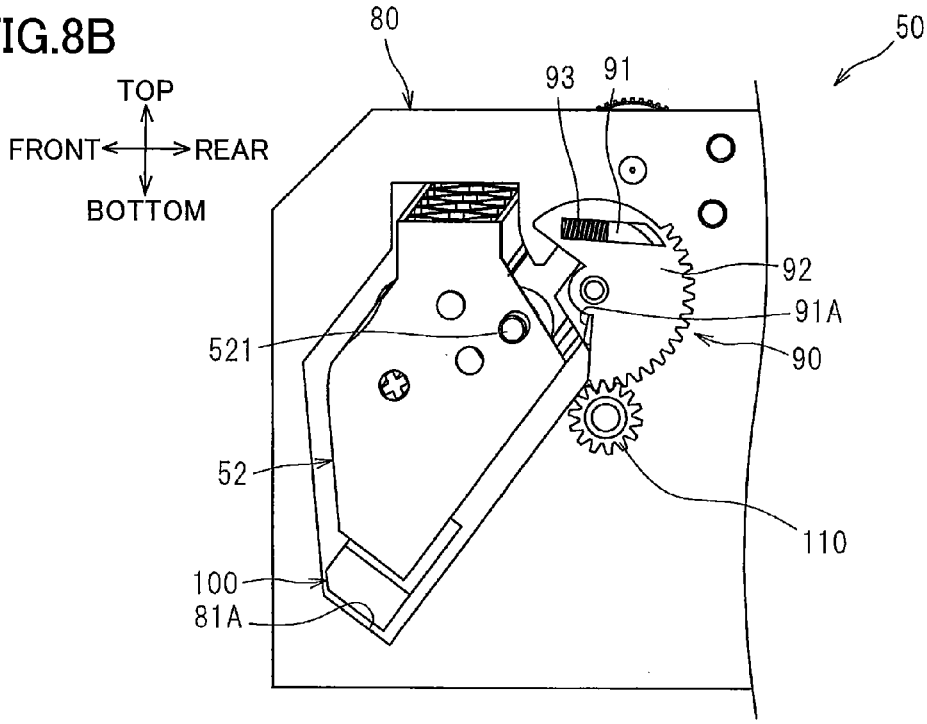
FIG. 8B is a partial side view of the photosensitive member unit in the state where the developing unit is at the pivoted position.

The moving assemblies 90 and the supporting members 100 having the above-described configurations allow the developing unit 52 to be moved to a proximity position as illustrated in FIGS. 3, 4A and 4B, a separated position as illustrated in FIGS. 5, 6A and 6B, and a pivoted position as illustrated in FIGS. 7, 8A and 8B.

More specifically, the proximity position is a position of the developing unit 52 at which the developing roller 52A is brought into proximity to (into contact with) the photosensitive drum 51. At this proximity position, the developing unit 52 is pressed against the photosensitive drum 51 by the corresponding right and left moving assemblies 90 while being supported thereby. In this state, the developing unit 52 is spaced away from the corresponding supporting member 100.

When the developing unit 52 is at the proximity position, the developing operation can be performed. In case of contact development, the developing roller 52 is in contact with the photosensitive drum 51 when the developing unit 52 is at the proximity position. In case of non-contact development, the developing roller 52 is not in contact with but in proximity to the photosensitive drum 51 when the developing unit 52 is at the proximity position.

The separated position is a position of the developing unit 52 at which the developing roller 52A is spaced apart from the photosensitive drum 51 while a parallel positional relationship therebetween is maintained. At the separated position, the developing roller 52A is positioned farther from the photosensitive drum 51 than at the proximity position. At this separated position, the supported state of the developing unit 52 by the corresponding right and left moving assemblies 90 is released, and the developing unit 52 is supported by the corresponding supporting member 100.

Figure 9:
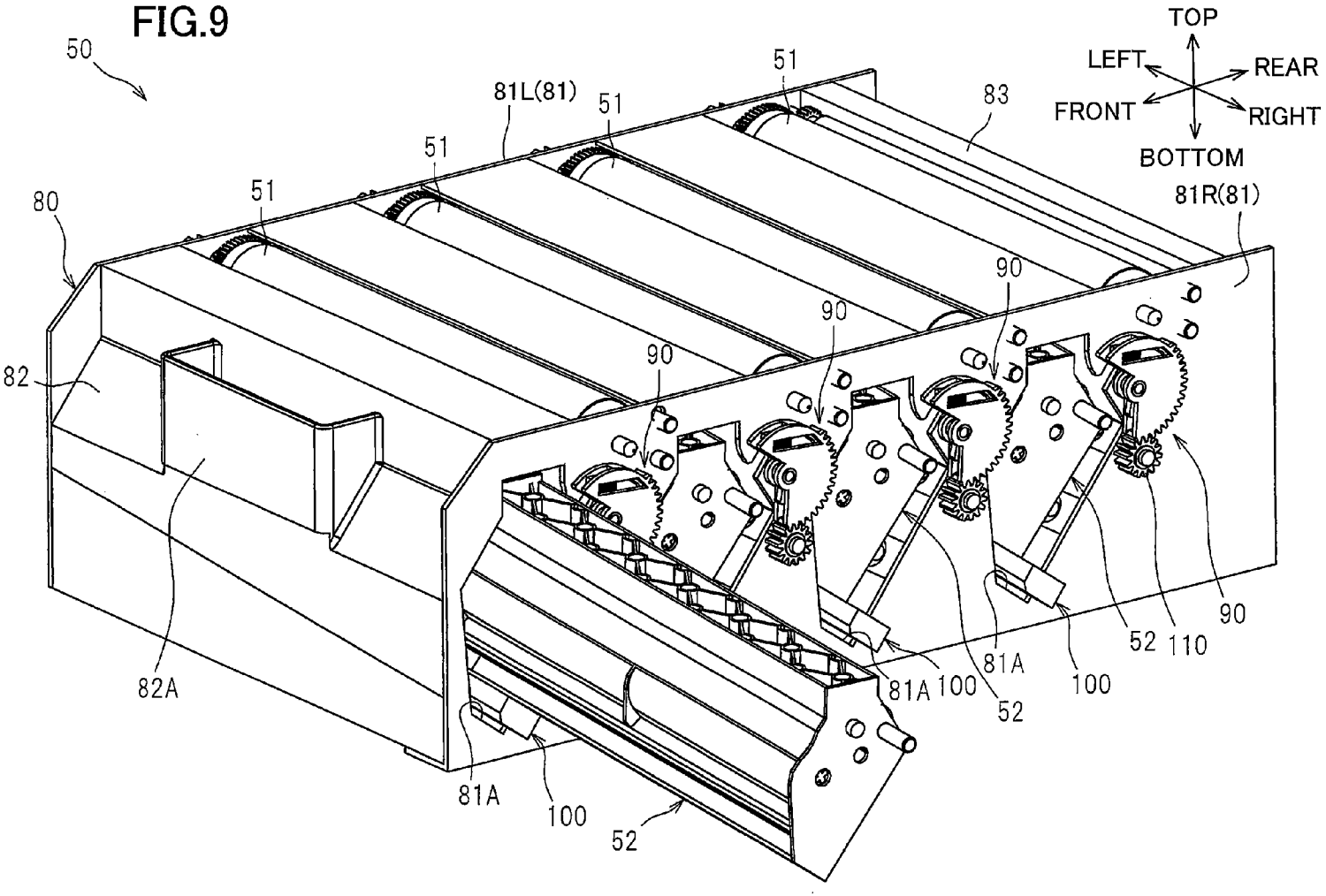
FIG. 9 is a perspective view of the photosensitive member unit in a state where one of the developing unit is drawn out in an axial direction from the pivoted position.

The pivoted position is a position of the developing unit 52 at which the developing roller 52A is pivotally moved about the pivot shaft 101 from the separated position in the direction away from the photosensitive drum 51. The developing unit 52, being supported by the supporting member 100 and pivotally moved from the separated position to the pivoted position to be set at the pivoted position, can be drawn (detached) from the drawer casing 80 along the axial direction of the developing roller 52A (in a diagonally rightward and downward direction), as illustrated in FIG. 9.

Thus, by pivotally moving the developing unit 52 from the separated position to the pivoted position, the developing roller 52A at the pivoted position can be distanced from the photosensitive drum 51 greater than at the separated position, so that the developing roller 52A can be prevented from interfering with the photosensitive drum 51 when the developing unit 52 is moved in the axial direction.

More specifically, as illustrated in FIGS. 3, 4A and 4B, the supporting member 100 is formed in an elongated shape extending in the rightward/leftward direction. The pivot shaft 101 provided at the left end portion of the supporting member 100 is pivotally movably supported to the drawer casing 80. Hence, the supporting member 100 can be pivotally moved between the separated position and the pivoted position together with the developing unit 52 while supporting the developing unit 52.

Further, the developing unit 52 is moved to the pivoted position by pivotally moving the supporting member 100, so that the developing unit 52 can be moved by an operation on one end portion of the supporting member 100 in the axial direction, which is easier than a case where the supporting member 100 is slidingly moved parallel to the photosensitive drum 51.

Further, the supporting member 100 is configured so as to guide the movement of the developing unit 52 in the axial direction. For example, as the guide structure, there can be exemplified a structure in which a convex portion and a concave portion that can be slidably engaged with each other in the axial direction are formed in an upper surface of the supporting member 100 and a lower surface of the developing unit 52, respectively.

As a result, the developing unit 52 can be drawn while being guided by the supporting member 100, so that the developing unit 52 can be prevented from interfering with the drawer casing 80.

The supporting member 100 has a right end portion protruding through an opening 81A of the drawer casing 80. This configuration allows a user to easily grip the supporting member 100, enhancing operability of the supporting member 100. Further, with such a configuration, the developing unit 52 can be drawn to the nearer side with respect to the user, facilitating taking-out of the developing unit 52 from the drawer casing 80.

The supporting member 100 is configured to be supported to the drawer casing 80 at the separated position in such a manner that a shallow concave portion formed in the right end portion of the supporting member 100 is engaged with a low convex portion formed in the right side wall 81R of the drawer casing 80.

Figure 10A:
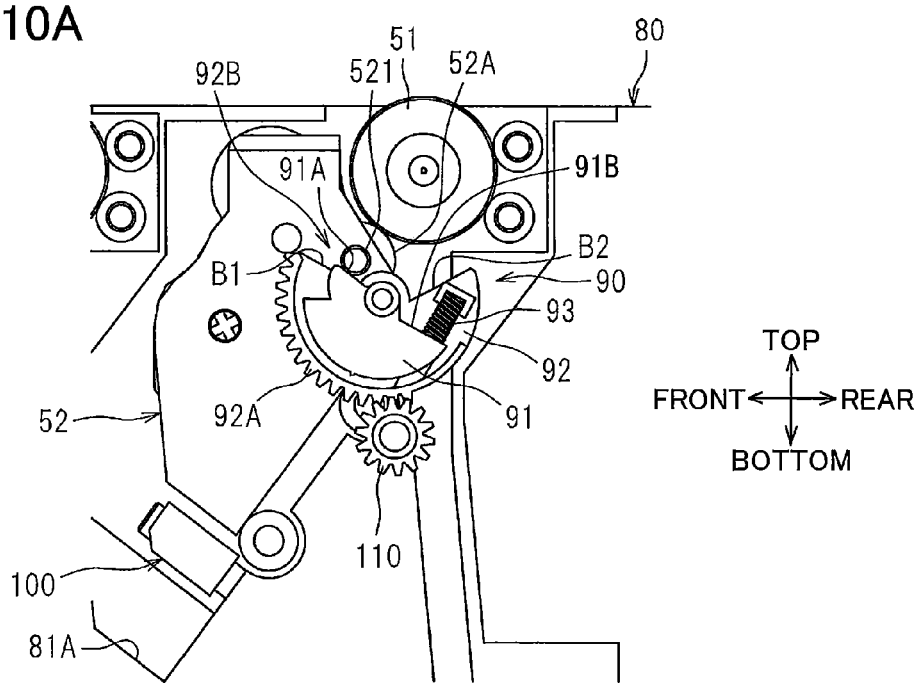

The supporting member 100 is disposed below the developing unit 52 (i.e. on an opposite side of the developing roller 52A with respect to the toner chamber 52D: see FIG. 1), whereas, as illustrated in FIGS. 3 and 10A, the moving assembly 90 is disposed on the developing roller 52A side. Thus, the moving assembly 90 and the supporting member 100 are distanced from each other, so that interference therebetween can be prevented.

Further, with this configuration, in a state where the supporting member 100 is pivotally moved to set the developing unit 52 at the pivoted position, the developing unit 52 can be drawn from the drawer casing 80 without interfere with the moving assembly 90.

Specifically, the moving assembly 90 includes a cam member 91, a gear member 92, and a coil spring 93.

The cam member 91 is formed in a generally sector shape and mounted to the drawer casing 80 through the gear member 92 so as to be pivotally movable with respect to the drawer casing 80 and the gear member 92.

The cam member 91 has, on its front side (downstream side of the cam member 91 in a pivotally moving direction of the cam member 91 in a state where the cam member 91 presses the developing unit 52 toward the proximity position), a cam surface 91A. The cam surface 91A is adapted to abut against the developing unit 52 to press the developing unit 52 in a direction from the separated position to the proximity position.

More specifically, at the proximity position illustrated in FIG. 10A, the cam surface 91A is configured to abut against a bearing portion 521 that supports a rotation shaft of the developing roller 52A from a diagonally lower-front side thereof.

Further, the cam member 91 has, on its rear side (upstream side of the cam member 91 in the pivotally moving direction of the cam member 91 in the state where the cam member 91 presses the developing units 52 toward the proximity position), an urged surface 91B.

The coil spring 93 is provided between the urged surface 91B of the cam member 91 and the gear member 92. The cam member 91 is urged in the clockwise direction in FIG. 10A by the coil spring 93. Thus, at the proximity position, the developing roller 52A is pressed against the photosensitive drum 51 by the urging force of the coil spring 93.

The gear member 92 has a hollow configuration so as to accommodate the cam member 91. The gear member 92 is pivotally movably provided at the drawer casing 80. The gear member 92 has a gear tooth portion 92A at a part of an outer peripheral surface thereof and a V-shaped notch 92B at the remaining part of the outer peripheral surface thereof. An intermediate gear 110 rotatably provided at the drawer casing 80 meshingly engages with the gear tooth portion 92A. To the intermediate gear 110, a clockwise or counterclockwise rotary drive force is transmitted as needed from a motor controlled by a control device (not illustrated) provided in the main casing 10.

Figure 10B:
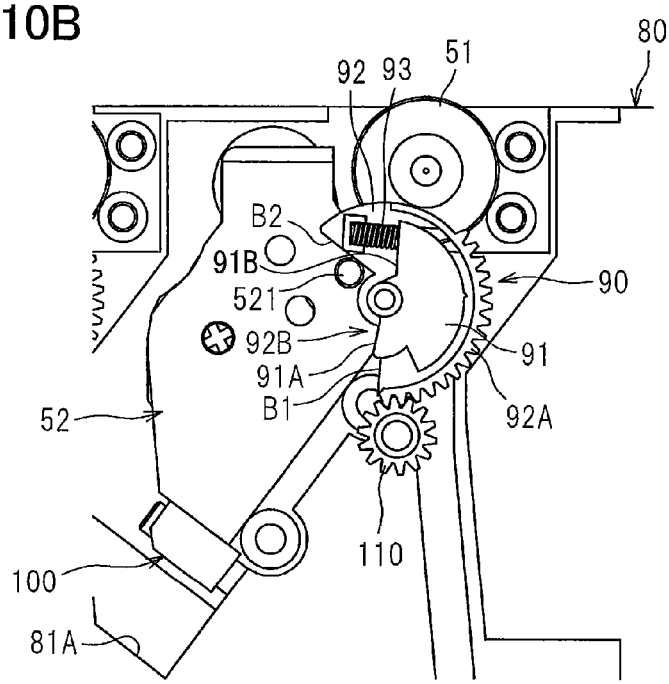

Specifically, for example, when a print mode is switched from a color mode to a monochromatic mode, a rotary drive force in one of the clockwise direction and the counterclockwise direction is transmitted to the intermediate gears 110 corresponding to the colors other than black, causing the corresponding gear members 92 to pivotally move counterclockwise from a state illustrated in FIG. 10A to a state illustrated in FIG. 10B. As a result, the supported state of the developing unit 52 by the cam members 91 is released, and the developing unit 52 is moved downward by its own weight (or by receiving pressure from end faces B2 (described later) of the gear members 92) to the separated position.

On the other hand, when the print mode is switched from the monochromatic mode to the color mode, a rotary drive force in the remaining one of the clockwise direction and the counterclockwise direction is transmitted to the intermediate gears 110 corresponding to the colors other than black, causing the corresponding gear members 92 to pivotally move clockwise from the state illustrated in FIG. 10B to the state illustrated in FIG. 10A. As a result, the developing unit 52 is pressed upward to the proximity position by the cam members 91 pivotally moving together with the gear members 92.

The bearing portion 521 of the developing unit 52 is disposed within the notch 92B. The notch 92B is defined by an end face B1 and the end face B2 of the gear member 92. In the state illustrated in FIG. 10A, the end face B1 is positioned frontward of the end face B2. At the proximity position illustrated in FIG. 10A, the cam surface 91A protrudes diagonally above and rearward from the end face B1 to abut against the bearing portion 521.

Further, at the separated position illustrated in FIG. 10B, the end face B2 abuts against the bearing portion 521 from a diagonally upper-rear side thereof. As a result, the bearing portion 521 is pressed by the end face B2 diagonally downward and frontward, thereby allowing the developing unit 52 to be moved reliably from the proximity position to the separated position.

As illustrated in FIG. 10B, in a state where the developing unit 52 is at the separated position, the notch 92B faces the opening 81A formed in the drawer casing 80. This eliminates the need to pivotally move the developing unit 52 from the separated position at a greater angle than, for example, in a configuration not including the notch in order for the developing unit 52 to be drawn from the drawer casing 80 without interference with the moving assembly 90, allowing a size reduction of the entire apparatus.

Further, in the state where the developing unit 52 is at the separated position, the moving assembly 90 has a portion overlapping the developing unit 52 as viewed in the rightward/leftward direction (axial direction). This allows a user to understand that the developing unit 52 at the separated position cannot be drawn from the drawer casing 80 in the axial direction due to presence of the moving assembly 90, thereby prompting the user to pivotally move the developing unit 52 to the pivoted position, which can reliably prevent interference between the developing roller 52A and the photosensitive drum 51.

Figure 11A:
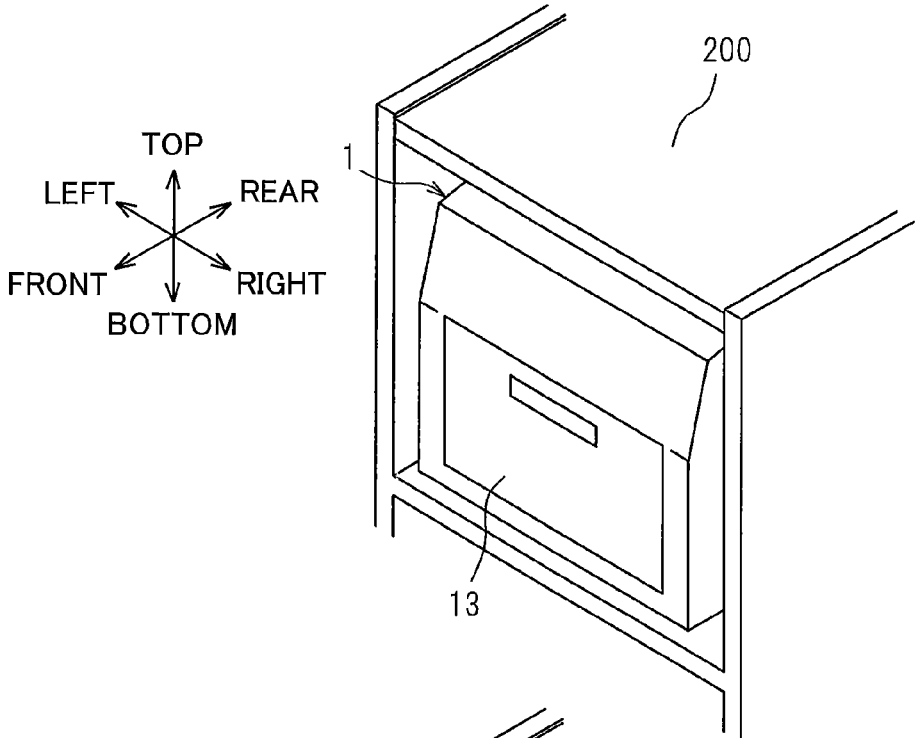
Figure 11B:
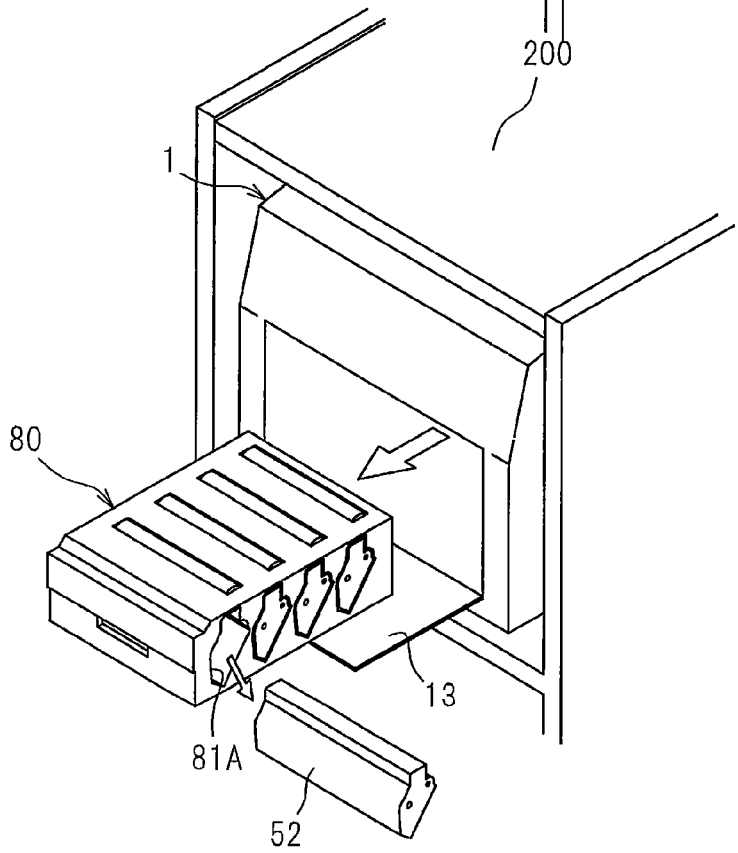

In the thus configured color printer 1, the developing unit 52 can be reliably replaced with new one even when the printer 1 is installed in a narrow shelf 200 as illustrated in FIG. 11A. More specifically, when the developing unit 52 is to be replaced with new one, the user initially opens the front cover 13 as illustrated in FIG. 11B.

At this time, the developing units 52 in the color printer 1 are all at the separated positions. The following can be considered as a method for allowing the developing units 52 to be moved to the separated positions at the opening of the front cover 13: the moving assembly 90 is configured to operate in conjunction with the pivotal movement (opening movement) of the front cover 13; or a sensor detecting the opening of the front cover 13 is provided and, based on a signal from the sensor, a control device controls a motor (or the moving assembly 90) such that each developing unit 52 is moved to the separated position.

After opening the front cover 13, the user draws the drawer casing 80 up to outside the shelf 200. Thus, in a state where the drawer casing 80 has been drawn, the openings 81A of the drawer casing 80 come out of a side wall of the shelf 200, allowing the developing units 52 to be attached to and detached from the drawer casing 80 through the openings 81A.

Thereafter, the user pushes down the right end portion of the supporting member 100 (not illustrated in FIG. 11B), whereby the developing unit 52 to be replaced can be drawn diagonally rightward and downward from the drawer casing 80 through the opening 81A.

In the case of a structure other than the drawer type in which the developing unit is drawn from the main casing through an opening formed in a side wall of the main casing, when the apparatus is installed in such a narrow shelf, the developing unit cannot be drawn in the rightward/leftward direction due to existence of the left and right side walls of the shelf, so that the drawer type of the present embodiment is especially effective when the apparatus is installed in the narrow shelf.

In the above-described embodiment, the following advantageous effects can be obtained in addition to those described above.

The moving assembly 90 is configured to be pivotally movable, so that a structure can be simplified more than in a configuration in which the moving assembly is configured to be, e.g., linearly movable.

Drawing-out of the drawer casing 80 allows drawing-out of the plurality of photosensitive drums 51 to a position outside the main casing 10 where replacement can be easily made, so that efficiency of the replacement work of the photosensitive drum 51 can be enhanced more than in a structure other than the drawer type in which the plurality of photosensitive drums are supported to the main casing.

The moving assembly 90 is provided at the drawer casing 80, so that positioning accuracy of the drawer casing 80 with respect to the main casing 10 need not be enhanced as compared to a configuration in which the moving assembly is provided at the main casing, thereby simplifying the structure.

Further, when the drawer casing 80 is drawn from the main casing 10, the moving assembly 90 and the drawer casing 80 are unlikely to interfere with each other.

Further, various modifications are conceivable.

Although the drawer casing 80 is exemplified as a claimed casing in the above-described embodiment, the present invention is not limited to this. For example, the casing may be the main casing. That is, a configuration may be possible in which the supporting member and the moving assembly are provided at the main casing, and the developing unit is drawn from the main casing through an opening formed in the main casing.

Although the moving assembly 90 and the supporting member 100 are formed as separate members in the above-described embodiment, the present invention is not limited to this. For example, the moving assembly and the supporting member may be formed as one combined member.

More specifically, for example, the supporting member 100 in the above-described embodiment may be made movable also in a direction pressing the developing roller against the photosensitive drum. That is, the supporting member may be configured to exert also the function of the moving assembly.

Although the present invention is applied to the color printer 1, the present invention is not limited to this. The present invention may be applied to another type of an image forming apparatus, such as a monochromatic printer, a monochromatic copier, or a monochromatic multifunction machine.

While the present invention has been described in detail with reference to the embodiment thereof, it would be apparent to those skilled in the art that various changes and modifications may be made therein without departing from the spirit of the present invention.

What is claimed is:

1. An image forming apparatus comprising:

a photosensitive drum;

a developing unit including a developing agent bearing member configured to supply a developing agent to the photosensitive drum, the developing agent bearing member having an axis extending in an axial direction and defining a first side and a second side opposite to the first side in the axial direction; and a casing configured to support the photosensitive drum and the developing unit, the casing having an opening at a position corresponding to the first side, the developing unit being detachable from and attachable to the casing through the opening, wherein the developing unit is configured to move selectively to one of a proximity position where the developing agent bearing member is in contact with or in proximity to the photosensitive drum, a separated position where the developing agent bearing member is spaced apart from the photosensitive drum while a parallel positional relationship between the developing agent bearing member and the photosensitive drum is maintained, and a pivoted position where the developing agent bearing member is pivotally moved about a portion of the developing agent bearing member at the second side from the separated position in a direction away from the photosensitive drum, the developing unit being configured to be detached from and attached to the casing along the axial direction in a state where the developing unit is at the pivoted position.

2. The image forming apparatus as claimed in claim 1, further comprising a supporting member pivotally movably provided at the casing and configured to support the developing unit, wherein the developing unit is configured to be moved between the separated position and the pivoted position together with the supporting member in conjunction with a pivotal movement of the supporting member.

3. The image forming apparatus as claimed in claim 2, wherein the supporting member is configured to guide a movement of the developing unit in the axial direction.

4. The image forming apparatus as claimed in claim 2, wherein the supporting member protrudes outward from the casing through the opening.

5. The image forming apparatus as claimed in claim 2, further comprising a moving assembly configured to move the developing unit to the proximity position and to the separated position.

6. The image forming apparatus as claimed in claim 5, wherein the moving assembly is pivotally movably provided at the casing and has a cam surface configured to abut against the developing unit to press the developing unit in a direction from the separated position to the proximity position.

7. The image forming apparatus as claimed in claim 6, wherein the moving assembly has a portion overlapping the developing unit as viewed in the axial direction when the developing unit is at the separated position.

8. The image forming apparatus as claimed in claim 6, wherein the moving assembly is formed with a notch facing the opening when the developing unit is at the separated position.

9. The image forming apparatus as claimed in claim 5, wherein the developing unit includes a developing agent accommodating portion configured to accommodate the developing agent therein.

10. The image forming apparatus as claimed in claim 9, wherein the moving assembly is positioned closer to the developing agent bearing member than to the developing agent accommodating portion; and wherein the supporting member is positioned opposite to the developing agent bearing member with respect to the developing agent accommodating portion.

11. The image forming apparatus as claimed in claim 5, further comprising a main casing configured to support the casing, the casing being configured to be accommodated in the main casing and drawn from the main casing.

12. The image forming apparatus as claimed in claim 11, wherein the photosensitive drum includes a plurality of photosensitive drums, the developing unit includes a plurality of developing units in one-to-one correspondence with the plurality of photosensitive drums, and the opening includes a plurality of openings in one-to-one correspondence with the plurality of developing units.

13. The image forming apparatus as claimed in claim 12, wherein each of the plurality of developing units is configured to be detached from and attached to the casing through the corresponding opening in a state where the casing has been drawn from the main casing.

14. The image forming apparatus as claimed in claim 13, wherein the moving assembly is provided at the casing.

15. An image forming apparatus comprising:

a photosensitive drum;

a developing unit including a developing agent bearing member configured to supply a developing agent to the photosensitive drum, the developing agent bearing member having an axis extending in an axial direction and defining a first side and a second side opposite to the first side in the axial direction; and a casing configured to support the photosensitive drum and the developing unit, the casing having an opening at a position corresponding to the first side, the developing unit being detachable from and attachable to the casing through the opening, wherein the developing unit is configured to move selectively to one of a proximity position where the developing agent bearing member is in contact with or in proximity to the photosensitive drum, and a pivoted position where the developing agent bearing member is pivotally moved about a portion of the developing agent bearing member at the second side from the proximity position in a direction away from the photosensitive drum, the developing unit being configured to be detached from and attached to the casing along the axial direction in a state where the developing unit is at the pivoted position.

16. The image forming apparatus as claimed in claim 15, further comprising a supporting member pivotally movably provided at the casing and configured to support the developing unit, wherein the developing unit is configured to be moved to the pivoted position together with the supporting member in conjunction with a pivotal movement of the supporting member.

17. The image forming apparatus as claimed in claim 16, wherein the supporting member is configured to guide a movement of the developing unit in the axial direction.

18. The image forming apparatus as claimed in claim 16, wherein the supporting member protrudes outward from the casing through the opening.

19. The image forming apparatus as claimed in claim 16, wherein the developing unit includes a developing agent accommodating portion configured to accommodate the developing agent therein; and wherein the supporting member is positioned opposite to the developing agent bearing member with respect to the developing agent accommodating portion.

* * * * *